US009156138B1

(12) United States Patent
Prescott

(10) Patent No.: US 9,156,138 B1
(45) Date of Patent: Oct. 13, 2015

(54) EXTENDED BAR CLAMP/SPREADER

(71) Applicant: Gregory Louis Prescott, Jupiter, FL (US)

(72) Inventor: Gregory Louis Prescott, Jupiter, FL (US)

( * ) Notice: Subject to any disclaimer, the term of this patent is extended or adjusted under 35 U.S.C. 154(b) by 444 days.

(21) Appl. No.: 13/734,007

(22) Filed: Jan. 4, 2013

Related U.S. Application Data

(60) Provisional application No. 61/631,407, filed on Feb. 3, 2012.

(51) Int. Cl.
*B25B 5/06* (2006.01)
*B25B 5/02* (2006.01)
*B25B 27/14* (2006.01)

(52) U.S. Cl.
CPC ..... *B25B 5/068* (2013.01); *B25B 27/14* (2013.01)

(58) Field of Classification Search
CPC ..... B25B 5/068; B25B 5/085; B25B 5/102; B25B 5/163; B25B 5/168
See application file for complete search history.

(56) References Cited

U.S. PATENT DOCUMENTS 1,583,611 A * 5/1926 Seely ..... 269/146
3,220,691 A * 11/1965 Dudley ..... 249/18
5,005,449 A * 4/1991 Sorensen et al. ..... 81/152
6,089,556 A * 7/2000 Whiteford ..... 269/149
6,152,434 A * 11/2000 Gluck ..... 269/6
6,530,565 B1 * 3/2003 Simpson ..... 269/6
7,114,715 B1 * 10/2006 Kirk ..... 269/147
7,226,046 B2 * 6/2007 Kloepfer et al. ..... 269/6
7,398,966 B2 * 7/2008 Hubbard ..... 269/88
2003/0075851 A1 * 4/2003 Alford ..... 269/147
2008/0086852 A1 * 4/2008 Hall et al. ..... 24/528

* cited by examiner

*Primary Examiner* — Lee D Wilson
*Assistant Examiner* — Tyrone V Hall, Jr.
(74) *Attorney, Agent, or Firm* — Glenn E. Gold; Gold & Rizvi, P.A.

(57) ABSTRACT

A bar clamp/spreading tool having a first clamp member with a curved arm that ends in a pad. The first bar clamp is fastened to an elongated beam that extends into and is attached to a beam housing. The beam housing includes a cavity. A variable length external member extends from the cavity into an assembly cavity of a primary housing. The primary housing includes a channel that receives a ratcheting rod. The bar clamp/spreading tool further includes a second clamp member that receives the ratcheting rod. The second clamp member has a ratcheting actuator for causing the second clamp member to ratchet down the ratcheting rod. This configuration results in a clamp. The first clamp member can be removed, flipped around and attached to the ratcheting member to form a spreading tool.

19 Claims, 4 Drawing Sheets

EXTENDED BAR CLAMP/SPREADER

CROSS REFERENCE TO RELATED APPLICATION

This application claims the benefit of U.S. provisional application No. 61/631,407, filed on Feb. 3, 2012 which is incorporated by reference as if fully set forth herein.

FIELD OF THE INVENTION

The present invention relates to building, construction, metalworking, and woodworking tools. More particularly the present invention is directed toward clamps for holding materials to be joined in place and to spreaders for spreading materials apart.

BACKGROUND OF THE INVENTION

One very common task in construction, welding, woodworking, plastic fabrication, ship building, and in general any material fabrication process is joining different elements together. Sometimes, such as when gluing wood elements together, long term pressure is required. At other times large, complex, and expensive fabrication facilities are required to properly align elements before joining. In certain cases various elements must be spread apart before elements can be properly fabricated. In almost all cases whenever discrete elements are being joined some type of spatial fixing is required.

Because of the wide variety of elements that must be joined or separated, a variety of devices are available to assist those processes. For example, the common "C" clamp is readily available in a wide range of sizes, from sub-inch maximum openings to well over 12". "C" clamps are available and suitable for wood-working, welding, and general assembly use and they can be used in a remarkable number of ways. While "C" clamps are very useful, they have practical limitations on their throat size maximum openings, depth of clamp, weight in larger sizes, and cost. Furthermore, "C" clamps can be difficult and time-consuming for one person to use, and cannot be used for spreading elements. However, their most common drawback is that they take two hands to use. Properly spatially locating and holding multiple elements while requiring two hands to clamp the multiple elements together can be a major challenge.

Because of the limitations of the "C" clamp other clamps are available. For example, bar clamps. A bar clamp is a clamping device consisting of a long rod, tube, bar, or other elongated member (generically referred to hereinafter for convenience and reading clarity simply as a rod), a fixed jaw on the rod, and a moving adjustable clamping jaw. In different configurations the moving jaw can be moved toward or away from the fixed jaw or the rod can be moved relative to the moving jaw. Some bar clamps can be used with only one hand, which greatly facilities their use. Bar clamps are available in configurations in which a jaw is reversible. This facilities their use as spreaders.

Examples of bar clamps include those taught in U.S. Pat. No. 6,382,608 to Mitchell, entitled, "Adjustable Clamping and Spreading Bar Clamp or Bench Vice," issued on May 7, 2002; U.S. Pat. No. 6,338,475 to Ping, entitled, "Bar Clamp," issued on Feb. 12, 2001; and U.S. Pat. No. 7,159,858, to Ben-Gigi, entitled "Bar Clamp," issued on Jan. 9, 2007. Examples of currently available bar clamps in different lengths are from Larin™, Craftsman™, Sears™, Pro-Grade™ and many others. Thus bar clamps and their ratcheting mechanisms are well known and commonly used.

While bar-clamps are widely used and have proven to be very useful, in some cases the maximum distance between the materials being joined is simply greater than the bar clamp can reach. Furthermore, as the distance between materials being joined increases the torques and other mechanical forces required to hold the materials rigid increase. Another major problem is that to span a wide range of distances either different bar clamps are required or a very long bar clamp that may be unwieldy for shorter applications is required.

Accordingly, there exists a need for a rigid, strong extended bar clamp/spreader that is suitable for one hand use over a wide span without being unwieldy. Beneficially such a bar clamp/spreader is suitable for low cost fabrication using efficient fabrication techniques.

SUMMARY OF THE INVENTION

The present invention overcomes the deficiencies of the known art and the problems that remain unsolved by providing a rigid, strong extended bar clamp/spreader that can be used with one hand use over a wide span and which is suitable for low cost, efficient fabrication.

In accordance with one embodiment of the present invention is a spreading tool having a ratcheting sliding rod that extends into a channel of an elongated primary housing. That housing includes a cavity at one end for receiving an external member and an external member aperture for receiving an external member pin for locking the external member in place. The spreading tool further includes a lower clamp member adjacent the primary housing and which receives part of the ratcheting sliding rod. The lower clamp member has a ratcheting actuator for ratcheting the ratcheting sliding rod arm up the channel. An upper clamp member is attached to the ratcheting sliding rod. When the sliding rod moves up the channel the upper clamp member moves away from the lower clamp member.

Beneficially the channel is "I" shaped and the channel is formed by at least two shaped rods that fit together inside the primary housing. The lower clamp member preferably includes a ratchet release lever and a plate that is disposed between the lower clamp member and the primary housing. In practice the upper clamp member will include a protective pad.

In accordance with another embodiment of the present invention is a clamping tool having a first clamp member, an elongated beam passing into the first clamp member, and a fastener attaching the first clamp member to the beam. The beam is beneficially "I" shaped. The clamping tool further includes a beam housing that receives an end of the beam. That beam housing further includes fasteners for attaching the beam to the beam housing and a cavity for receiving an end of an external member. The other end of the external member fits into an assembly cavity of an elongated primary housing. The primary housing further includes a channel for a ratcheting rod that extends from the channel. The ratcheting rod is fixed within the channel. A second clamp member receives part of the ratcheting rod. The second clamp member includes a ratcheting actuator for causing the second clamp member to ratchet down the ratcheting rod.

In practice the first clamp member may include a protective pad for contacting a material being spread, while the channel may be "I" shaped. If "I" shaped, the channel is preferably formed using shaped rods that are placed inside the primary housing. For easy operation the second clamp member beneficially includes a ratchet release lever, and the ratcheting rod is fixed within the channel by a lock pin.

In accordance with yet another embodiment of the present invention, the invention is a tool having a first clamp member with a curved arm that ends in a pad. An elongated beam is attached to the first clamp member by a fastener. In turn, the beam extends into and is attached within the beam housing. The beam housing includes a cavity at a second end. An external member extends from the cavity and is fixed to the beam housing. The other end of the external member is received within an assembly cavity of an elongated primary housing. The primary housing also includes a channel that receives a ratcheting rod that extends from the channel and which is fixed within the primary housing. The tool further includes a second clamp member that receives the ratcheting rod. The second clamp member has a ratcheting actuator for causing the second clamp member to ratchet down the ratcheting rod.

In practice the channel may be "I" shaped, while the channel may be formed from rods placed inside the primary housing. The second clamp member beneficially includes a ratchet release lever, and the ratcheting rod is fixed within the primary housing by a lock pin. A plate may be disposed between the lower clamp member and the primary housing. The external member consists of a material selected from steel, aluminum, plastic, and wood.

These and other aspects, features, and advantages of the present invention will become more readily apparent from the attached drawings and the detailed description of the preferred embodiments, which follow.

BRIEF DESCRIPTION OF THE DRAWINGS

The preferred embodiment of the invention will hereinafter be described in conjunction with the appended drawings that are provided to illustrate but not to limit the invention, in which.

Like reference numerals refer to like parts throughout the several views of the drawings. In addition, the terms "a" and "an" as used herein do not denote a limitation of quantity, but rather denote the presence of at least one of the referenced parts.

DETAILED DESCRIPTION

The following detailed description is merely exemplary in nature and is not intended to limit the described embodiment or the application and uses of the described embodiment. As used herein, the word "exemplary" or "illustrative" means "serving as an example, instance, or illustration." Any implementation described herein as "exemplary" or "illustrative" is not necessarily to be construed as preferred or advantageous over other implementations. The implementations described below are exemplary implementations provided to enable persons skilled in the art to make or use the embodiment of the disclosure and are not intended to limit the scope of the disclosure, which is defined by the claims.

Figure 1:
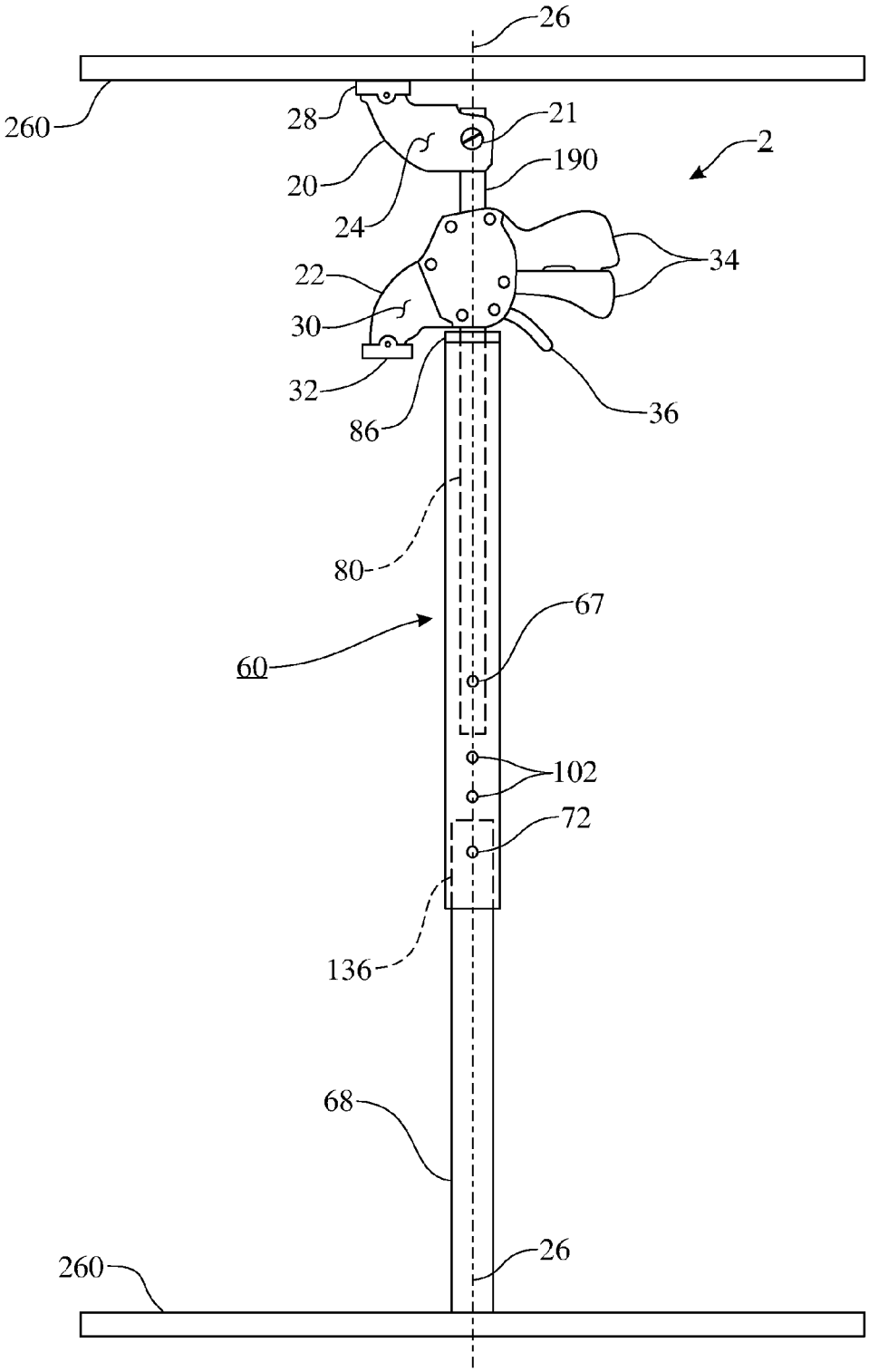
FIG. 1 presents a side view of an extended bar clamp/spreader tool 2 that is in accordance with the present invention spreading apart materials 260.

For purposes of description herein, unless otherwise described the terms "upper", "lower", "top", "bottom", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 3:
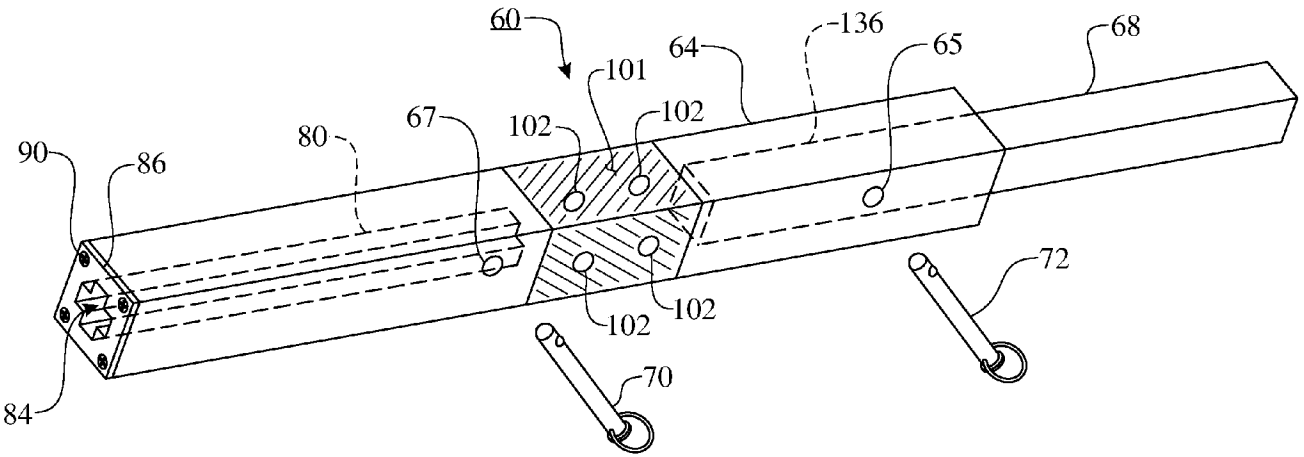
FIG. 3 illustrates the female assembly 60 of the extended bar clamp/spreader tool 2 shown in FIGS. 1 and 2.

The present invention provides for a novel, unobvious, and useful extended bar clamp/spreader tool 2 that implements a long, easily used, highly stable bar clamp and bar spreader system. FIG. 1 shows the extended bar clamp/spreader tool 2 spreading materials 260 apart while FIG. 3 shows the extended bar clamp/spreader tool 2 clamping materials 260 together. The extended bar clamp/spreader tool 2 is suitable for one-handed operation and for use with a wide range of materials 260.

Referring now primarily to FIG. 1 the extended bar clamp/spreader tool 2 includes a first clamp member 20, a second clamp member 22, an elongated "I" shaped ratchet bar 190 (similar to the "I" beam 132 shown in FIG. 4), and a female assembly 60 (shown in more detail in FIG. 3). The extended bar clamp/spreader tool 2 is an elongated assembly that extends along an axis 26.

Figure 2:
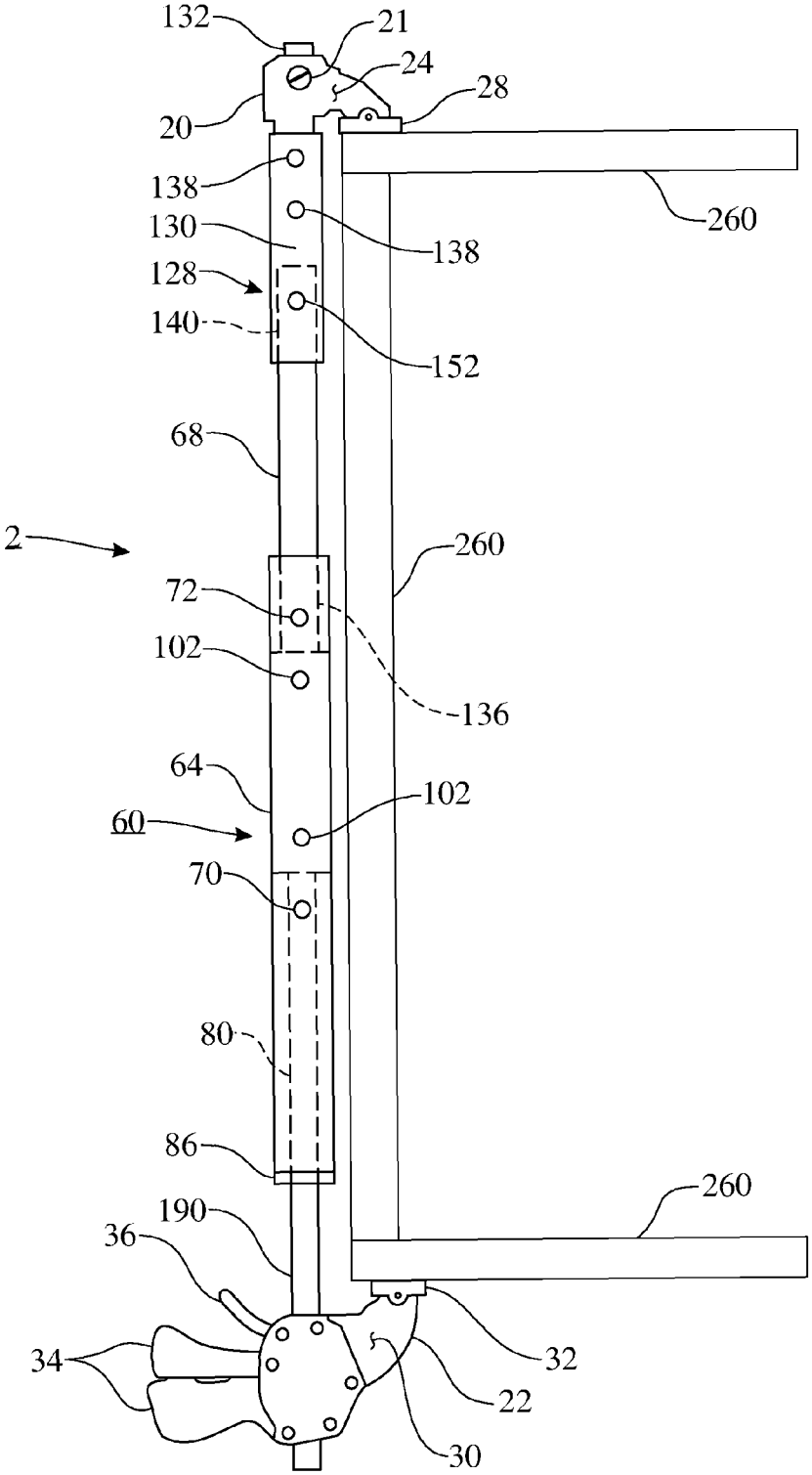
FIG. 2 presents a side view of the extended bar clamp/spreader tool 2 shown in FIG. 1 when clamping materials 260.

The first clamp member 20 has a first arm 24 that extends away from the axis 26 and then curves into a first mount 28 that runs perpendicular to the axis 26. In practice the first mount 28 will be comprised of a plastic or hard rubber material suitable for clamping or expanding a material without marring or other damage. However, the first mount 28 may also be made from a material such as steel or aluminum for durability and strength. The first clamp member 20 is detachable from the ratchet bar 190 by removing a clamp mounting bolt 21 that passes thought the first clamp member 20 and the ratchet bar 190. The first clamp member 20 is configured such that it can be removed, flipped over, then reattached to the extended bar clamp/spreader tool 2 with the first mount 28 facing the other direction, as shown in FIG. 2. As is described subsequently, attachment of the first clamp member 20 may be accomplished without using the ratchet bar 190. This enables the extended bar clamp/spreader tool 2 to be used for both clamping and spreading.

The second clamp member 22 has a second arm 30 that extends away from the axis 26 and then curves into a second mount 32 that runs perpendicular to the axis 26. The second mount 32 will usually be comprised of the same material as the first mount 28.

The second clamp member 22 further includes a ratchet squeeze actuator 34 in the shape of a handle. When a user squeezes the ratchet squeeze actuator 34 the ratchet bar 190 moves "up" relative to the second clamp member 22. Continued squeezing continues to move the ratchet bar 190 up. Thus a user can move the ratchet bar 190 with one hand. The second clamp member 22 also includes a release lever 36. When the release lever 36 is released by a user the ratchet bar 190 can move down relative to the second clamp member 22.

Still referring to FIG. 1, the second clamp member 22 rests on the female assembly 60 which retains an external member 68 in a female assembly cavity 136 using an external member pin 72. The ratchet bar 190 extends into an "I" rod assembly 80 of the female assembly 60. The first clamp member 20 and the external member 68 span between materials 260. The female assembly 60 further includes a beam pin aperture 67 whose use is described subsequently.

As a user squeezes the ratchet squeeze actuator 34 the ratchet bar 190 moves up while the second clamp member 22 remains on the female assembly 60. As the first clamp member 20 is attached to the ratchet bar 190, squeezing the ratchet squeeze actuator 34 causes the first and second clamp members 20, 22 to separate, forcing the external member 68 down. As the external member 68 contacts a bottom material 260 while the first clamp member 20 contacts a top material 260, the top and bottom materials 260 are spread apart by squeezing the ratchet squeeze actuator 34. Importantly the lengths of the female assembly 60 and the external member 68 control how far apart the materials 260 can be spread.

FIG. 2 shows the extended bar clamp/spreader tool 2 set up for clamping. As shown, the first mount 28 faces downward while the second mount 32 faces upward. The first clamp member 20 has been removed from the ratchet bar 190 and attached to an "I" beam 132 (see FIG. 4). The "I" beam 132 is attached to an "I" extension 128 having an "I" housing 130 by retention screws 138. The "I" extension 128 has a cavity 140 that receives an external member 68 which has been cut-to-fit the particular application. The external member 68 is drilled to form a hold through which a cavity pin 152 passes to hold the external member 68 in place.

The second clamp member 22 ratchets on the ratchet bar 190 which still extends into the female assembly 60. However, the ratchet bar 190 now passes through the "I" rod assembly 80 and is pinned in place by an "I" beam pin 70 that passes through the primary housing 64 of the female assembly 60 and the ratchet bar 190. This locks the ratchet bar 190 in place. The female assembly 60 also receives an end of the external member 68 within a female assembly cavity 136. The external member 68 is drilled to form a hold through which an external pin 72 passes to prevent the external member 68 from coming out. In addition, the female assembly 60 includes an inner stop 101 (reference FIG. 3) that is held in place by inner stop retaining screws 102. The inner stop 101 acts with the external pin 72 in preventing the external member 68 from moving toward the second clamp member 22.

When a user squeezes the ratchet squeeze actuator 34 the second clamp member 22 moves up along the ratchet bar 190 which causes the first and second clamp members 20, 22 to come toward each other. As the first clamp member 20 and the second clamp member 22 spans a bottom material 260, a top material 260, and an intermediate material 260, the top, bottom and intermediate materials 260 are clamped together. The length of the external member 68 can be used to control how far apart the materials 260 can be clamped.

The first clamp member 20, the second clamp member 22, and the "I" shaped ratcheting bar 190 are similar to those mentioned above in the Background of the Invention. As such the ratcheting mechanism is well known and for simplicity and clarity of understanding the invention they will not be described in detail.

Figure 7:
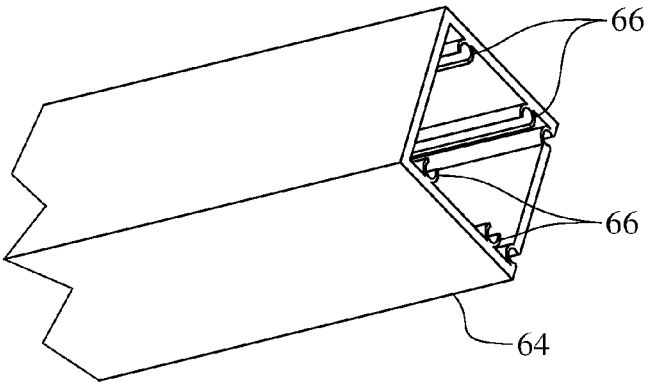
FIG. 7 shows the primary housing 64 of the extended bar clamp/spreader tool 2 shown in FIGS. 1 and 2.

Turning now to FIG. 3 the female assembly 60 enables a long, strong, adjustable, and ridge extension of a basic clamping system. It is comprised of multiple sections that are arranged and configured to achieve a desired configuration. In particular, the female assembly 60 includes an elongated primary housing 64. As best shown in FIG. 7, the primary housing 64 is a hollow, rectangular member that includes screw receiving slots 66 that run along inside the walls of the primary housing 64. In practice, the primary housing 64 is configured to be able receive a 1½" by 1½" external member 68 at one end. The external member 68 is preferably a square rod or bar made from plastic, steel, aluminum, some other metal, or wood and which is cut or otherwise fabricated to the required length to either spread or clamp materials 260 in the particular application.

Referring again to FIG. 3, the primary housing 64 includes the inner stop 101 that is fixed in place by a plurality of inner stop retaining screws 102 that pass through the primary housing and into the inner stop 101. The inner stop 101 acts to limit how far into the primary housing 64 the external member 68 can travel. As such, the inner stop 101 can be a solid member or it may be hollow but with a wall thickness suitable for preventing the external member 68 sliding all the way up the primary housing 64. In some implementations the inner stop 101 may be an integral part of the primary housing 64. But for easy of fabrication (discussed in more detail subsequently) the inner stop 101 is beneficially a separate member.

Figure 6:
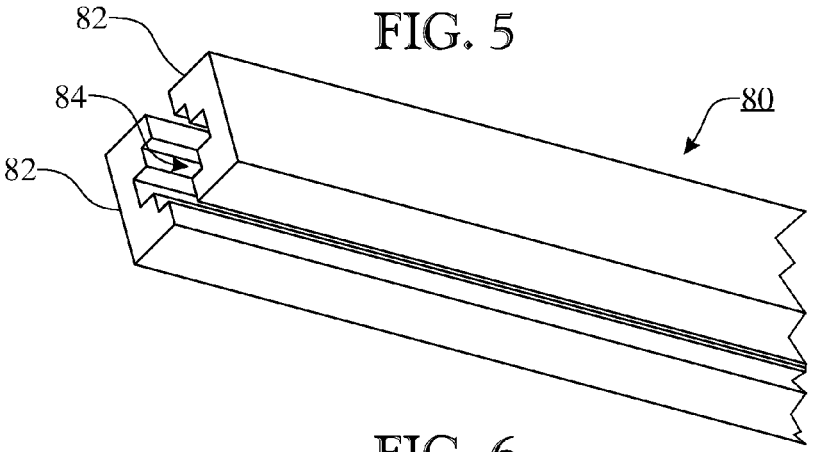
FIG. 6 illustrates the "I" rod assembly 80 and its "I" channel 84 that is formed from facing slotted bars 82 and which is used in the extended bar clamp/spreader tool 2 shown in FIGS. 1 and 2.

Referring now to FIGS. 3 and 6, the primary housing 64 also receives at the end opposite that which receives the external member 68, an "I" rod assembly 80. The "I" rod assembly 80 forms an elongated "I" channel 84 which receives the "I" shape elements 190 and 132 (which is received depends on the application). The "I" rod assembly 80 is beneficially comprised of two identical slotted bars 82 that are positioned face to face to form an outer perimeter in the form of a square that tightly fits into the primary housing 64. In practice the slotted bars 82 will form something like a 1½" by 1½" square. The "I" rod assembly 80 span the distance from the adjacent side of the inner stop 101 to the end of the primary housing 64. Thus when the "I" rod assembly 80 is inserted into the primary housing 64 the end of the "I" rod assembly 80 fits flush with the end of the primary housing 64 and against the inner stop 101.

Figure 5:
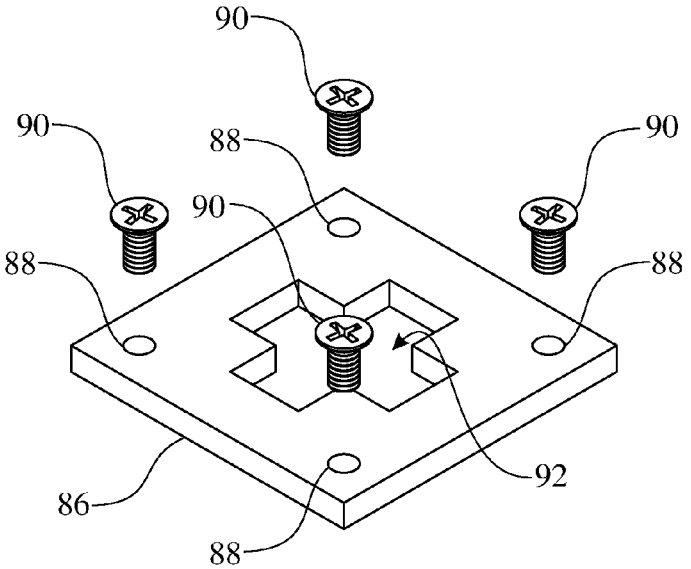
FIG. 5 shows the "I" plate 86 of the extended bar clamp/spreader tool 2 shown in FIGS. 1 and 2.

Referring now to FIGS. 3 and 5, the "I" rod assembly 80 is kept within the primary housing 64 by an "I" plate 86. The "I" plate 86 includes four (4) screw apertures 88 for receiving plate screws 90. The "I" plate 86 is dimensioned to fit over the end of the primary housing 64 such that the screw apertures 88 align with the screw receiving slots 66 of the primary housing 64. Plate screws 90 are screwed into the screw receiving slots 66 to hold the "I" plate 86 in place. This retains the "I" rod assembly 80 inside the primary housing 64.

As best understood by reference to FIGS. 5 and 6 the "I" plate 86 includes an "I" shaped aperture 92. With the "I" plate 86 screwed onto the primary housing 64 the "I" shaped aperture 92 aligns with the "I" channel 84 formed by the "I" shaped rod assembly 80. Preferably the "I" shaped aperture 92 and the "I" channel 84 are the same size.

Because of the elongated nature of the primary housing 64, its requirements of strength and rigidity, as well as the need to incorporate the screw receiving slots 66 in the primary housing 64, the primary housing 64 is beneficially made from extruded aluminum. Extruding aluminum enables the primary housing 64 to have a wall thickness that provides the required strength, close dimensional tolerances, direct fabrication of the screw receiving slots 66, almost any length, all at relatively low cost and with relatively light weight. However, extruded aluminum does not lend itself to direct fabrication of the interior stop 101. Thus the inner stop 101 is beneficially a separate member located inside the primary housing 64 after extrusion. Alternatively the primary housing 64 can be machined from any suitable material to form an integral inner stop 101, in which case the inner stop retaining screws 102 are not required. In any event an external member aperture 65 and an beam pin aperture 67 can be drilled or punched after fabrication of the primary housing 64 to enable respective insertions of the "I" beam pin 70 and the external member pin 72.

Figure 4:
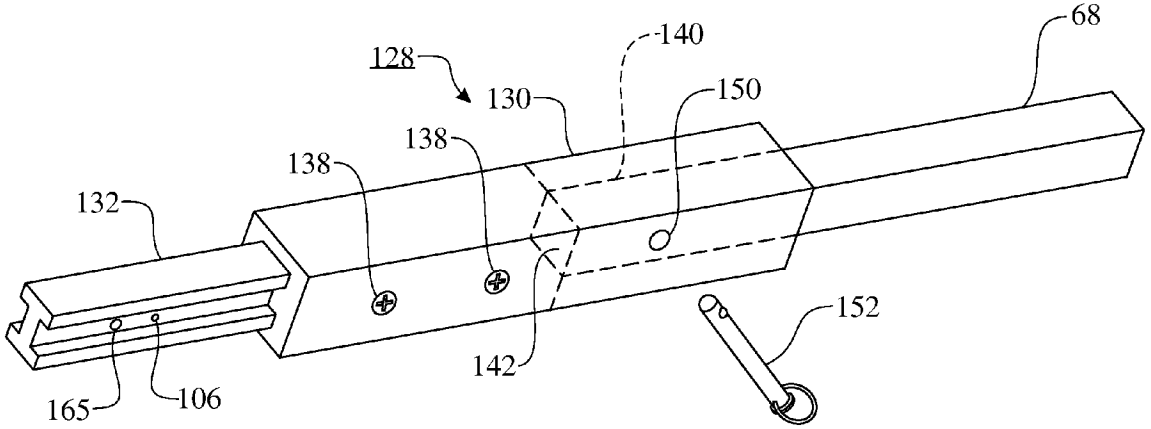
FIG. 4 illustrates the "I" extension 128 of the extended bar clamp/spreader tool 2 shown in FIGS. 1 and 2.

Referring now to FIG. 4, extended bar clamp/spreader tool 2 further includes the "I" extension 128 having the "I" housing 130. The "I" housing 130 is slotted to receive part of the elongated "I" beam 132. The remainder of the "I" beam 132 protrudes from the "I" housing 130. The "I" beam 132 includes a first receiving hole 106 and a second receiving hole 165 to receive the clamp member bolt 21 (only one receiving hole is used at a time). The "I" beam 132 is retained in the "I" housing 130 by a plurality of retention screws 138 such that the "I" housing 130 and the "I" beam 132 form a rigid structure. Alternatively a protruding "I" beam could be formed by machining a solid "I" housing.

Still referring to FIG. 4, the end of the "I" housing 130 opposite the protruding "I" beam 132 is formed into a cavity 140 for receiving the external member 68. To retain the external member 68 in place the top 142 of the cavity 140 acts as an upper stop and cavity apertures 150 are formed through the cavity 140. Those cavity apertures 150 are dimensioned to receive a cavity pin 152 that passes through the "I" housing 130 and through an external element 68 to lock those elements together.

Because of the elongated nature of the "I" housing 130 and the "I" beam 132, their requirements of strength and rigidity, as well as the rather complex "I" shaped forms that are required, both the "I" housing 130 and the "I" beam 132 are beneficially fabricated from extruded aluminum. Extruded aluminum readily provides the required "I" shapes, both external and internal, as well as the required strengths and dimensional tolerances. Furthermore, extrusion can form parts of almost any practical length at relatively low cost and with a relatively light weight. As previously noted, extruded aluminum does not lend itself to direct fabrication of an interior stop. Thus an interior stop can be provided as a separate member or the cavity 140 can be machined to have an interior stop. In any event the cavity apertures 150 and apertures for the retention screws 138 can be drilled or punched after fabrication of the "I" housing 130.

The above-described embodiment extended bar clamp/spreader tool 2 is merely exemplary for setting forth a clear understanding of the principles of the invention. Many variations, combinations, modifications or equivalents may be substituted for elements thereof without departing from the scope of the invention. Therefore, it is intended that the invention not be limited to the particular embodiments disclosed as the best mode contemplated for carrying out this invention, but that the invention will include all the embodiments falling within the scope of the appended claims.

What is claimed is:

1. A spreading tool, comprising:

a ratcheting sliding rod;

an elongated primary housing having a cavity at one end for receiving an external member, said primary housing further including an external member aperture for receiving an external member pin and a channel at the end opposite the cavity receiving a length of said ratcheting sliding rod;

a lower clamp member adjacent said primary housing receiving said ratcheting sliding rod, said lower clamp member having a ratcheting actuator for ratcheting said ratcheting sliding rod arm up said channel; and an upper clamp member attached to said ratcheting sliding rod;

wherein said upper clamp member moves away from said lower clamp member as said ratcheting sliding rod moves up said channel;

also wherein said channel is formed by at least two rods fit together inside said primary housing.

2. The spreading tool according to claim 1, wherein said channel is "I" shaped.

3. The spreading tool according to claim 1, wherein said lower clamp member includes a ratchet release lever.

4. The spreading tool according to claim 1, further including an external member locked in said cavity by said external member pin.

5. The spreading tool according to claim 1, further including a plate disposed between said lower clamp member and said primary housing.

6. The spreading tool according to claim 1, wherein said upper clamp member includes a protective pad.

7. A clamping tool, comprising:

a first clamp member;

an elongated beam passing through said first clamp member;

a fastener attaching said beam to said first clamp member;

a beam housing attached to said beam, said beam housing having a cavity for receiving an end of an external member;

an elongated primary housing having an assembly cavity for receiving a second end of the external member, said primary housing further having a channel;

a ratcheting rod extending from said channel and fixed within said primary housing; and a second clamp member receiving part of said ratcheting rod, said second clamp member having a ratcheting actuator for causing said second clamp member to ratchet down said ratcheting rod.

8. The clamping tool according to claim 7, wherein said first clamp member includes a protective pad.

9. The clamping tool according to claim 7, wherein said channel is "I" shaped.

10. The clamping tool according to claim 9, wherein said channel is formed by two shaped rods inside said primary housing.

11. The clamping tool according to claim 7, wherein said second clamp member includes a ratchet release lever.

12. The clamping tool according to claim 7, wherein said ratcheting rod is fixed within said primary housing by a lock pin.

13. A tool, comprising:

a first clamp member having a curved arm ending in a pad;

an elongated beam attached to said first clamp member by a fastener;

an elongated beam housing attached to said beam, said beam housing including a cavity at a second end;

an external member extending from and fixed to said beam housing;

an elongated primary housing having an assembly cavity receiving a second end of said external member, said primary housing further having a channel opposite said external member;

a ratchet rod fixed within said primary housing and extending from said channel; and a second clamp member receiving said ratchet rod, said second clamp member having a ratcheting actuator for causing said second clamp member to ratchet down said ratchet rod.

14. The tool according to claim 13, wherein said channel is "I" shaped.

15. The tool according to claim 14, wherein said channel is formed from rods inside said primary housing.

16. The tool according to claim 13, wherein said second clamp member includes a ratchet release lever.

17. The tool according to claim 13, wherein said ratchet rod is fixed within said primary housing by a lock pin.

18. The tool according to claim 13, further including a plate disposed between said second clamp member and said primary housing.

19. The tool according to claim 13, wherein said external member consists of a material selected from a list comprising steel, aluminum, plastic, and wood.

* * * * *